United States Patent [19]

Rapkin

[11] Patent Number: 5,016,062

[45] Date of Patent: May 14, 1991

[54] MULTICOLOR IMAGE FORMING APPARATUS HAVING IMPROVED REGISTRATION

[75] Inventor: Alan E. Rapkin, Fairport, N.Y.

[73] Assignee: Eastman Kodak Company, Rochester, N.Y.

[21] Appl. No.: 459,851

[22] Filed: Jan. 2, 1990

[51] Int. Cl.[5] ..... G03G 15/01; G03G 15/16

[52] U.S. Cl. ..... 355/327; 355/212; 355/272; 355/317; 346/157

[58] Field of Search ..... 355/212, 272, 317, 326, 355/327; 346/153.1, 160, 157; 358/300

[56] References Cited

U.S. PATENT DOCUMENTS

| | | | |
|---|---|---|---|
| 4,162,843 | 7/1989 | Inoue | 355/327 |
| 4,232,961 | 11/1980 | Masuda | 355/271 |
| 4,308,821 | 1/1982 | Matsumoto et al. | 118/645 |
| 4,599,285 | 7/1986 | Haneda et al. | 430/54 |
| 4,629,669 | 12/1986 | Shoji et al. | 430/47 |
| 4,661,429 | 4/1987 | Molaire et al. | 430/70 |
| 4,662,739 | 5/1987 | Sakai | 364/142 |
| 4,664,501 | 5/1987 | Koizumi et al. | 355/327 |
| 4,690,542 | 9/1987 | Furuta et al. | 355/327 |
| 4,731,634 | 3/1988 | Stark | 355/328 |
| 4,752,804 | 6/1988 | Ohno | 355/327 |
| 4,796,050 | 1/1989 | Furuta et al. | 355/317 |
| 4,803,515 | 2/1989 | Hoshino et al. | 355/271 |
| 4,821,066 | 4/1989 | Foote, Jr. et al. | 346/160 |
| 4,835,570 | 5/1989 | Robson | 346/160 |
| 4,860,035 | 8/1989 | Mealeman et al. | 346/157 |

FOREIGN PATENT DOCUMENTS

| | | | |
|---|---|---|---|
| 61-145567 | 7/1986 | Japan | 355/212 |

*Primary Examiner*—Joan H. Pendegrass
*Attorney, Agent, or Firm*—Leonard W. Treash, Jr.

[57] ABSTRACT

An apparatus for forming multicolor toner images includes an endless web having rows of perforations along each edge. In one embodiment, two or more drums have sprockets on each end. These sprockets engage the rows of perforations in the web. Toner images of different color are created in each drum by creating electrostatic images and toning those images with toners of different colors. The toner images are transferred in registration to the web. The number of perforations in the web is chosen to create a small amount of slack between the drums which permits the sprocket teeth to orient the web with respect to each drum thereby preventing misregistration due to skew, for example, because of misalignment of the axes of the drums. According to a second embodiment a similar registration scheme is used with images that are formed by exposing and toning the same portion of a photoconductive web with toners of different color.

17 Claims, 8 Drawing Sheets

MULTICOLOR IMAGE FORMING APPARATUS HAVING IMPROVED REGISTRATION

RELATED APPLICATIONS

This application is related to co-assigned:

U.S. patent application Ser. No. 459906, filed Jan. 2, 1990, METHOD AND APPARATUS FOR FORMING MULTICOLOR IMAGES, Alan E. Rapkin; and U.S. patent application Ser. No. 459850, filed Jan. 2, 1190, METHOD AND APPARATUS FOR FORMING MASTERS AND IMAGES THEREFORM, John W. May et al.

1. Technical Field

This invention relates to the formation of multicolor images, and more particularly, to an apparatus which has improved skew registration in the formation of multicolor toner images.

2. Background Art

Pending U.S. patent application Ser. No. 304,093 in the name of Mahoney and Benwood, shows an apparatus and method for making multicolor toner images using four drums and an intermediate transfer web. In one embodiment the four drums were each separate photoconductive imaging members which create different color toner images which are transferred in registration to the intermediate transfer member to create a multicolor image which is then transferred to a receiving sheet in a single step. In a second embodiment, each drum is covered with a xeroprinting master, each of which create different color toner images which are transferred in registration to the intermediate transfer member.

A number of other references show parallel processes in which the images are transferred from separate photoconductors to a receiving sheet or to an intermediate transfer member, see, for example U.S. Pat. Nos. 4,232,961; 4,690,542; 4,662,739; 4,803,515; 4,162,843; 4,796,050; 4,664,501; 4,752,804. U.S. Pat. No. 4,835,570 shows manual application of xeroprinting masters to a series of drums which are used to make multicolor images for transfer directly to a receiving sheet.

A number of references suggest a different form of parallel process in which a photoconductive member is first charged then exposed to create a first electrostatic image, and that first image is developed with the toner of a first color. The same area of photoconductor is then charged again without fusing or cleaning the first image and is again exposed to a second image. The second image is toned with a toner of a second color without disturbing the first toner image. This can be repeated, adding colors and forming a multicolor image, which can be transferred in a single step. See, for example, U.S. Pat. Nos. 4,308,821; 4,629,669; 4,599,285; 4,731,634.

All of these parallel processes have the advantage of making multicolor images at roughly the same speed that each individual image can be made. This is a substantial improvement in speed over the present commercial electrophotographic color systems in which color toner images are made consecutively on the same imaging member.

However, registration of images which are transferred or formed at separate locations along the path of a web is a serious problem toward which many solutions have been suggested. Thus far, no registration solution has been totally satisfactory. The above-mentioned Mahoney and Benwood application suggests provision of perforations along one edge of the web and sprockets for each drum. The sprockets then control both image formation and transfer with respect to either the leading or trailing edge of the perforation. This approach handles in-track registration extremely well, which is by far the most serious registration problem. However, for highest quality work, attention must be given to the possibility that the web will skew as a result, either because of poor tracking or of slight lack of parallelism of the axes of the drums.

DISCLOSURE OF THE INVENTION

It is the object of this invention to provide an apparatus for forming multicolor images generally of the types described above but which corrects for misregistration due to skewing of the primary imaging web.

These and other objects are accomplished by an apparatus in which an endless web cooperates with a plurality of imaging members. Toner images are formed on the imaging members and transferred in registration to the web or to a receiving sheet carried by the web. The web has first and second rows of perforations along opposite edges. Each of the imaging members includes a drum shaped member having first and second sprockets positioned to cooperate with the sets of perforations. The number of perforations in the web between drums is chosen to create slack between the drums, thereby permitting complementary perfs on each drum to directly orient the web with respect to that drum, even though there is a tendency of the web to skew, for example, because of some misalignment between the axes of the drums.

According to another aspect of the invention, the images are forced electrophotographically directly on the web with exposure of each color controlled by a separate drum, with each drum having a pair of sprockets which cooperate with a pair of rows of perforations in the web.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
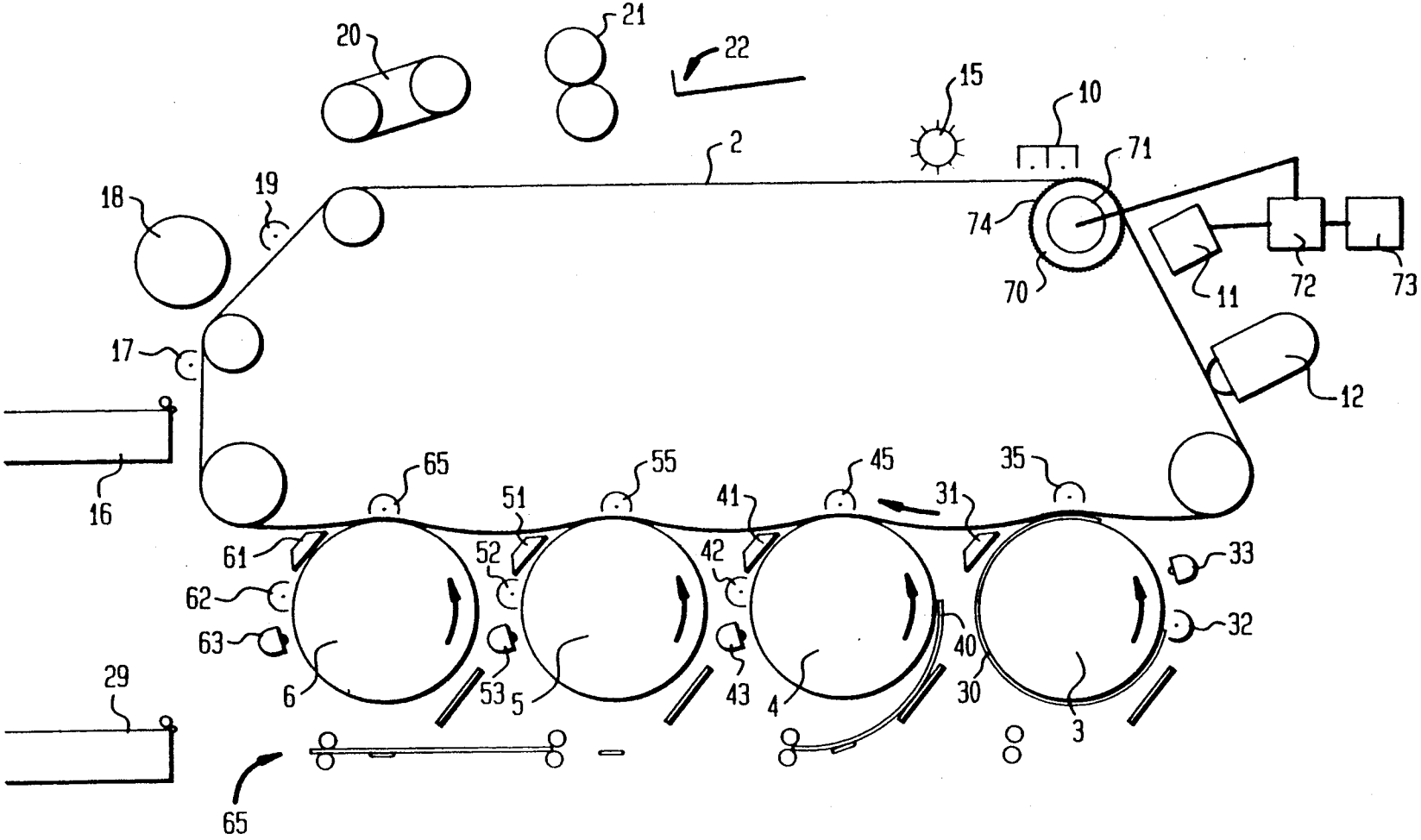
FIG. 1 is a schematic side view of an apparatus for making and using masters to make multicolor toner images.

According to FIG. 1, multicolor imaging apparatus 1 has a primary imaging member, for example, a photoconductive endless web 2 and four secondary imaging members 3, 4, 5 and 6, positioned along the path of endless web 2. Also along the path through which web 2 is moveable is a charging station 10, an exposure station 11, a development station 12, transfer stations 17 and 19 and a cleaning station 15.

The secondary imaging members 3, 4, 5 and 6 are identical secondary imaging drums. Each secondary imaging member rotates through a path bringing it past its own fusing station 31, 41, 51 and 61, charging station 32, 42, 52 and 62 and toning station 33, 43, 53 and 63, respectively.

Figure 2:
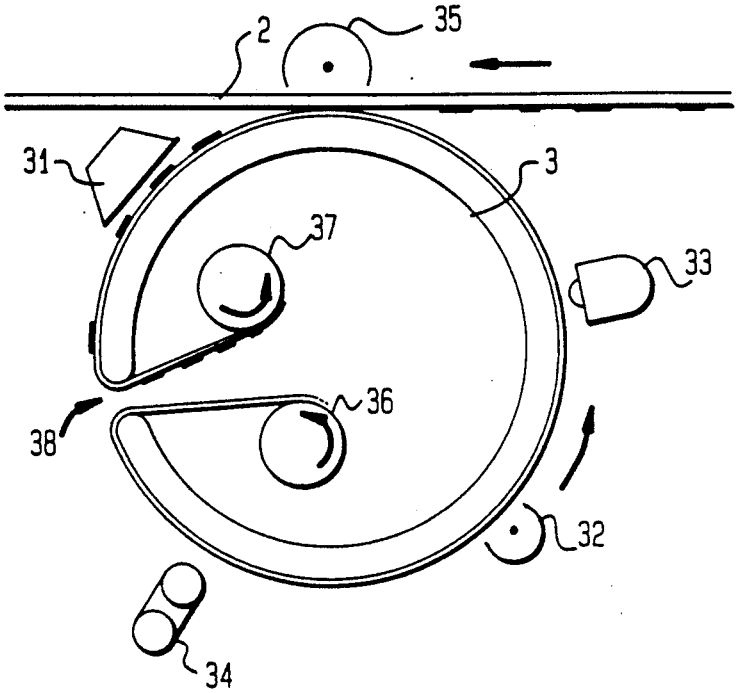
FIGS. 2 and 3 are side views of a portion of the apparatus shown in FIG. 1, including in FIG. 2 an alternative embodiment of the FIG. 1 apparatus.

In operation, apparatus 1 has two modes. In its first, or master-making mode, a uniform electrostatic charge is laid down on primary imaging member 2 by charging station 10. An exposure station 11 exposes imaging member 2 to create a series of electrostatic images which are toned using insulative toner of any color by toning station 12 to create a series of primary or master toner images. Each primary toner image is transferred to a different one of the secondary imaging members. For example, as shown in FIG. 2, a first primary toner image is transferred to secondary imaging member 3 where it is fixed by fusing station 31. Second, third and fourth primary toner images are formed by stations 10, 11 and 12 and transferred to secondary imaging members 4, 5 and 6 respectively, where they are also fixed. The transfer of the primary toner images to the secondary imaging members is accomplished electrostatically, for example, by a field between the secondary imaging members and transfer corona chargers 35, 45, 55 and 65. If a primary toner image is to be transferred to secondary imaging member 4, 5 or 6, the transfer charger 35 and other upstream transfer chargers should be turned off or reversed to prevent transfer at the incorrect secondary imaging member.

In the embodiment shown in FIG. 1, the toner is insulative in character and each of the secondary imaging members is conductive or can be made conductive by exposure to radiation. Therefore, once the toner is fixed to the secondary imaging member it forms a xeroprinting master.

Figure 3:
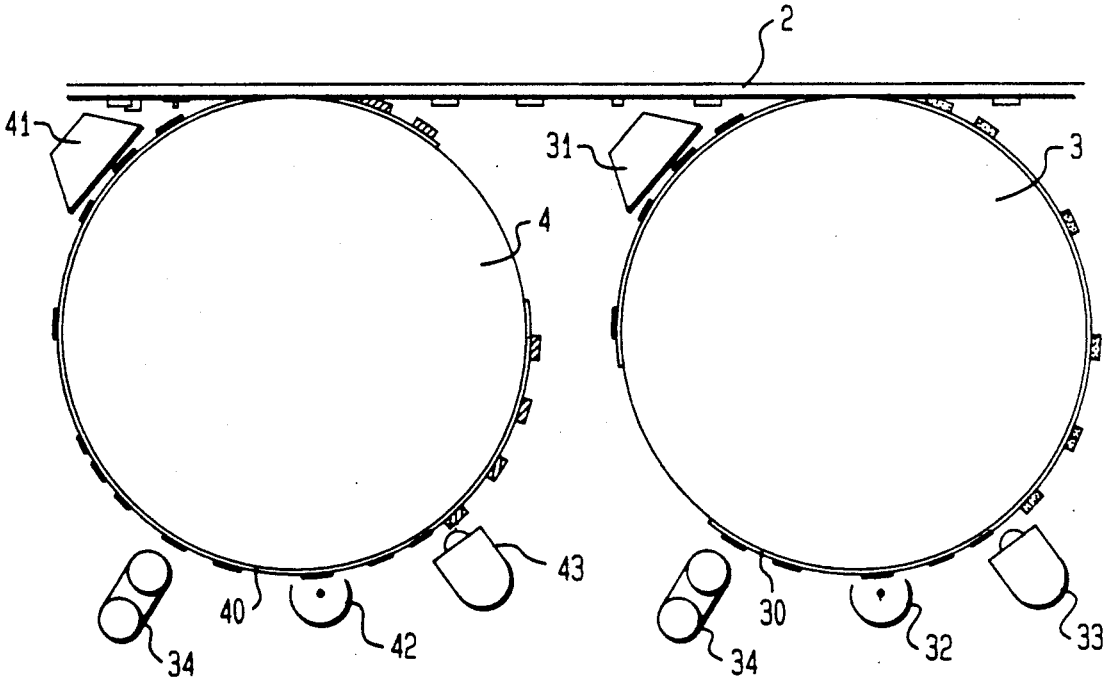

In its second, or duplicating mode, apparatus 1 is first run to clean any residual toner off primary imaging member 2 at cleaning station 15. Charging station 10, exposure station 11, developing station 12 and fusing stations 31, 41, 51 and 61 are inactivated. Charging stations 32, 42, 52 and 62 and toning stations 33, 43, 53 and 63 are activated. The toners in each of toning stations 33, 43, 53, and 63 are of different color. As shown in FIG. 3, secondary imaging members 3, 4, 5 and 6 are then each charged at charging stations 32, 42, 52 and 62 and toned at toning stations 33, 43, 53 and 63 to create transferable toner images of different color defined by the xeroprinting masters, that is, previously fused primary toner images originally transferred from web 2. The transferable toner images created on secondary imaging members 3, 4, 5 and 6 are transferred in registration back to primary imaging member 2 to create a multicolor image.

For example, toning station 33 contains black toner to create a black toner image representing the portions of the final multicolor image that are intended to be black. Similarly, toning stations 43, 53 and 63 contain cyan, magenta and yellow toners, respectively, to create cyan, magenta and yellow toner images on secondary imaging members 4, 5 and 6, respectively.

Either polarity toner may be used in toning either the charged or discharged areas of the xeroprinting masters. However, transfer back to the primary imaging member 2 can be made with the same polarity transfer chargers 35, 45, 55 and 65 if the colored toner is opposite in polarity to the primary or master toner.

The multicolor toner image formed by transfer of the transferable toner images to primary imaging member 2 can be utilized by transferring it to a receiving sheet fed from receiving sheet supply 16 which is fed into transfer station 17 to receive the multicolor image. A second multicolor image can be transferred to the reverse side of the receiving sheet at a second transfer station 19 after the sheet has been turned over in a turnover device 18 in a manner well-known in the art. The receiving sheet is then transported by a transport mechanism 20 to a fuser 21 and ultimately to an output tray 22. For a similar structure, see previously referred to patent application to Mahoney and Benwood.

In order to do duplex with this structure, the primary toner images are formed in pairs, representing opposite sides of the proposed final sheet. Each pair of images is transferred to a secondary imaging member. Thus, each secondary imaging member must be large enough to support two images consecutively on its periphery.

The xeroprinting masters can be formed by transfer of the primary toner images directly onto a conductive surface of secondary imaging members 3, 4, 5 and 6. When the number of multicolor images that are desired in the duplicating mode are made, the fused toner can be cleaned off by cleaning stations, not shown, at each of the secondary imaging members. However, cleaning fused toner off a surface is a difficult task and seriously limits the materials that can be used. Therefore, a preferred approach, illustrated in FIG. 1, is to attach a separate blank master sheet around a drum support of each of secondary imaging drums 3, 4, 5 and 6 which sheets are conductive, receive the insulative toner and have it fused to its surface and then can be removed when the desired number of multicolor images have been made so that a new set of multicolored images can be formed.

As shown in FIG. 1, the blank master sheets from a master sheet supply 29 are fed along a master feed path 65 and automatically wrapped around secondary imaging members 3, 4, 5 and 6. A conductive master 30 has been wrapped around imaging member 3, a second conductive master 40 is being fed into position to be wrapped around secondary imaging member 4. Alternatively, these masters could be wrapped on drums 3, 4, 5 and 6 by hand.

FIG. 2 illustrates another preferred embodiment in which the blank master is not a separate sheet, but is a continuous web. According to FIG. 2, each secondary imaging member has a supply roller 36 and a take-up roller 37 which handle a continuous web of blank master material which is trained around drum 3 through an exit 38. The supply and take-up rollers 36 and 37 can be indexed when new blank master material is desired to form new multicolor images.

The cycle of operation would begin with the feeding of master sheets from master sheet supply 29 through a path 65 with appropriate guides to feed a separate master sheet to each of secondary imaging members 3, 4, 5 and 6. Each of master sheets from master sheet supply 29 is attached to a separate imaging member by suitable means, for example, holding fingers or vacuum as is well-known in general in the electrophotographic art. If the FIG. 2 approach is used, fresh master material is indexed to each secondary imaging member peripheral surface.

Then, stations 10, 11, and 12 are activated and four primary toner images are created each representing separate separations of appropriate colors to form a single multicolor image. As shown best in FIG. 2, each of the four images is transferred to a separate master on a separate one of secondary imaging members 3, 4, 5 and 6 and fused there by fusing stations 31, 41, 51 and 61. Thus far, the operation has been at a slow master-making speed.

As best shown in FIG. 3, at this point, the apparatus can be sped up substantially as the multicolor images are created on the secondary imaging members 3, 4, 5, and 6 and transferred back to primary imaging member 2 and to receiving sheets from receiving sheet supply 16. A cleaning station 34 is shown which is not necessary but may improve image quality with some materials.

Exposure station 11 can be optical or electronic. However, a high resolution laser or multilevel LED printhead is preferred. Because the ultimate duplicating mode can be operated quite fast, overall speed of the process is not hurt by use of a relatively slow but high quality electronic exposure for defining the masters. For example, with high volume runs, the apparatus is quite feasible when run at one inch per second or less in its master making mode and at more than ten inches per second in its duplicating mode. Toning station 12 can tone either the charged or discharged portions of the electrostatic image. However, if electronic exposure is used, especially using an LED printhead, discharged portion toning is preferred.

Figure 5:
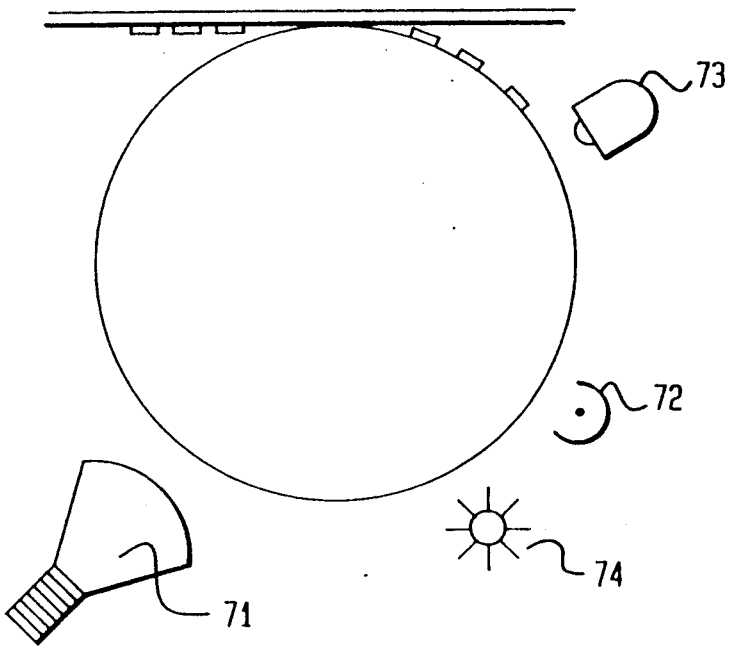
FIGS. 4 and 5 are side views of an individual imaging member constructed according to an alternative embodiment of the imaging members shown in FIGS. 1 and 2.
Figure 4:
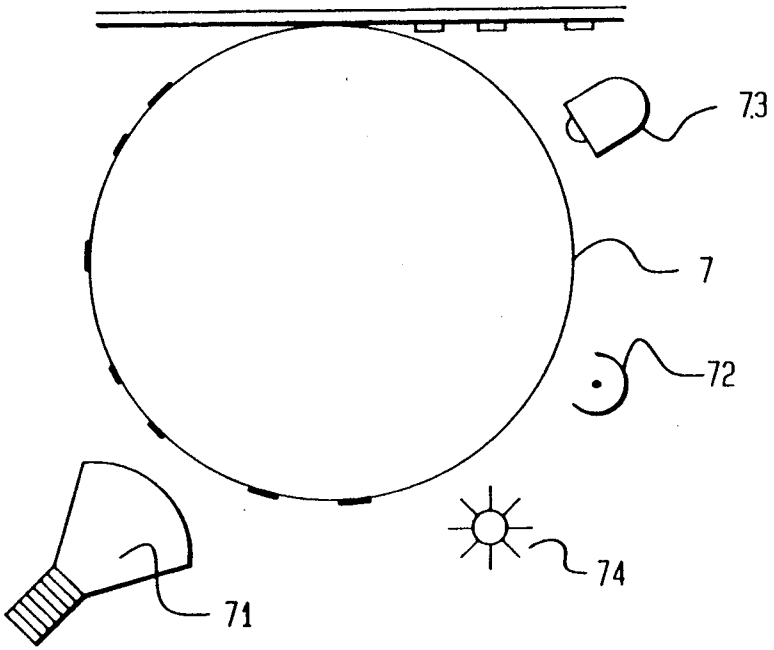

FIGS. 4 and 5 show another preferred embodiment of the invention. In this embodiment, the outer surface of the secondary imaging members is formed of a layer of substance which persistently changes its conductivity in an electrographic sense when treated. For example, a number of materials become less able to hold a charge on a surface after exposure to intense ultraviolet radiation and that characteristic persists for a period of time; in some instances, permanently, or until treated with heat. In some instances, the material is not affected by normal visible radiation. See, for example, U.S. Pat. No. 4,661,429. Also, many normal photoconductors such as zinc oxide retain a conductivity image for a short length of time after imagewise exposure to normal visible radiation.

According to FIG. 4, a secondary imaging member 7 has an outer layer of such a persistent conductivity material or a sheet or web having a layer of such a material attached to the member 7 as in FIGS. 1-3. The FIG. 2 approach is particularly advantageous. The primary toner image is formed of a toner opaque to ultraviolet radiation and is transferred to imaging member 7. The outer layer of active material is exposed to an ultraviolet source creating a persistent conductivity image defined by the primary toner image. The toner, having not been fused is cleaned off by a cleaning device 74. The outer layer of member 7 can then function as a planographic xeroprinting master as shown in FIG. 5 again using a charging station 72 and a toning station 73. It may be desirable to use cleaning device 74 in the duplicating mode for highest quality imaging. This embodiment has the advantage of permitting reuse of the master since some forms of it can be regenerated by the lapse of time or application of heat. A heating station 77 is shown in FIGS. 4 and 5 for that purpose.

Figure 6:
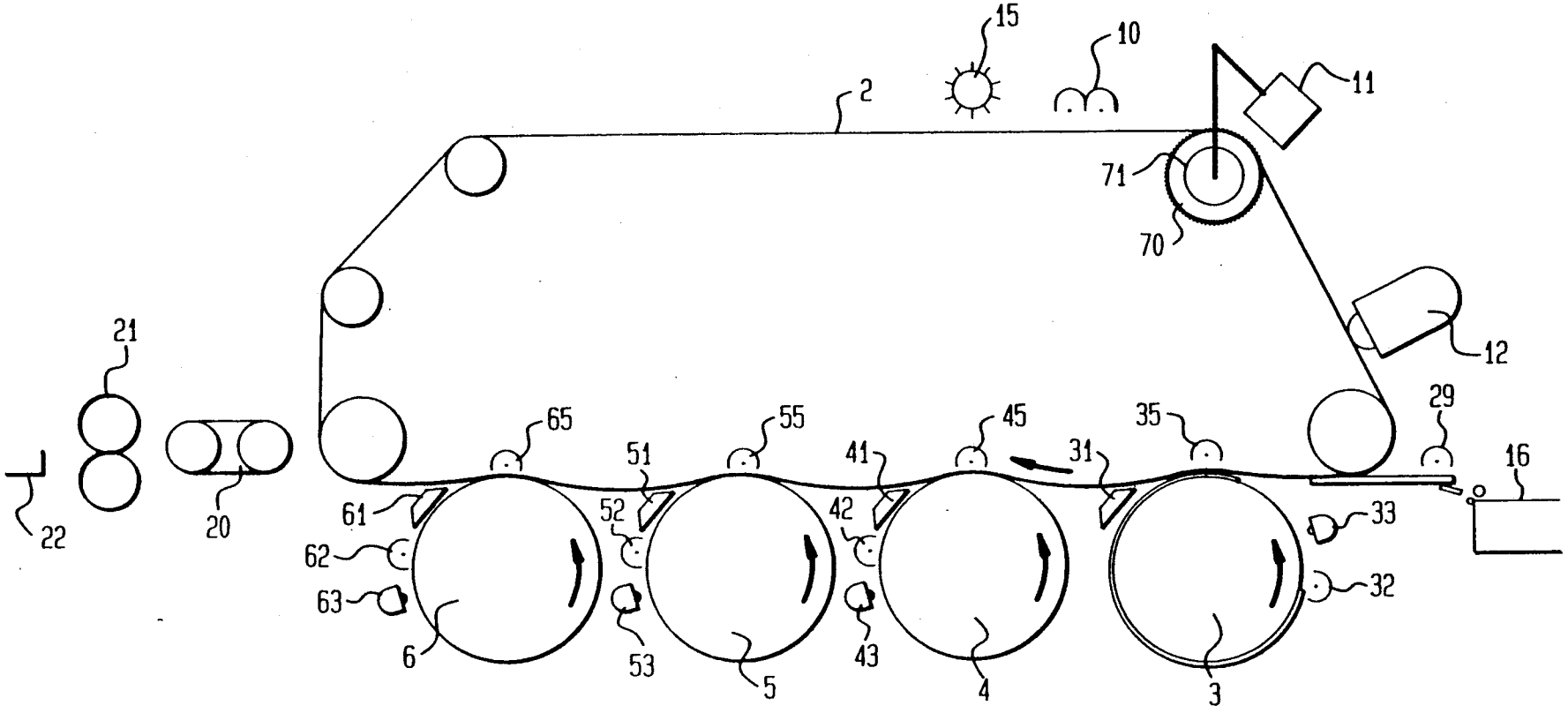
FIG. 6 is a side view of another embodiment of the multicolor image forming apparatus of FIG. 1.

The preferred form of the invention is shown in FIGS. 1-5 where the color images are transferred directly back to the primary imaging member 2. However, as shown in FIG. 6, it also can be used to transfer the color images to a receiving sheet carried by the primary imaging member. Sheets are fed from receiving sheet supply 16 into contact with member 2. They are held by member 2 by vacuum, gripping fingers, electrostatics or a combination thereof. As shown in FIG. 6, the back of the sheets are sprayed with an electrostatic charge by a charger 29 to hold the sheets to member 2. They are carried through transfer stations 35, 45, 55 and 65 by member 2 and separated therefrom and transported by transport 20 to fuser 21 and to output tray 22. Duplex is accomplished by recirculation of the sheet by means not shown.

The process and apparatus shown in FIGS. 1-6 is particularly usable with xeroprinting masters because toner is applied to the primary and secondary imaging members in each mode. However, with proper choice of materials, other duplicative processes with other masters also could be used. Similarly, the master sheets 30, 40, 50 and 60 could be photoconductive and an illumination means placed between charging means 32, 42, 52, 62 and toning means 33, 43, 53, 63. Obviously, either the charged or the discharged areas could be toned.

Registration can be maintained by putting a set of perforations along an edge of primary imaging member 2 and a sprocket fixed to and coaxial with each of secondary imaging members 3, 4, 5 and 6. The primary imaging member 2 can be driven by one of its rollers to drive the secondary imaging members and force each sprocket to the rear edge of the controlling perforations. A sprocket 84 around a printhead roller 80 also follows the rear edge of the perforations and is connected to an encoder 81 which controls exposure of web 2 by exposure station 11 through a logic and control unit 82 utilizing image data from a source 83. Alternatively, in both instances, tendency drive mechanisms can be used to maintain both the sprocket associated with printhead roller 80 and that associated with each secondary imaging member at the front of the perforations.

Preferably, each separate image formed on primary imaging member 2 to be transferred to secondary imaging members 3, 4, 5 and 6 is formed on a separate revolution of primary imaging member 2. This forces the same points in consecutive master images to be controlled by the same perforations in imaging member 2 and controls any problems in the manufacture or maintenance of the primary imaging member 2 and its perforations. The same perforation is used again in the duplicating mode. This timing mechanism is similar in some respects to one shown in previously cited Mahoney and Benwood application and in U.S. Pat. No. 4,821,066 to Foote et al. However, it is carried several steps further. A single perforation on web 2 controls the placement of a given image point on consecutive primary toner images. It controls that point each time that image is transferred to secondary imaging member 3, 4, 5 or 6 and further when the transferable color images are formed it controls their transfer back to primary imaging member 2 thereby correcting for most imperfections in both the manufacture and maintenance of web 2 and the secondary imaging members 3, 4, 5 and 6. Registration of the masters is done automatically.

FIGS. 7–10 illustrate an improved version of the above registration approach which is usable not only for each of the apparatus shown in FIGS. 1–6 but is also usable with other apparatus in which color images are formed at different positions and transferred or formed in registration on a web.

Figure 8:
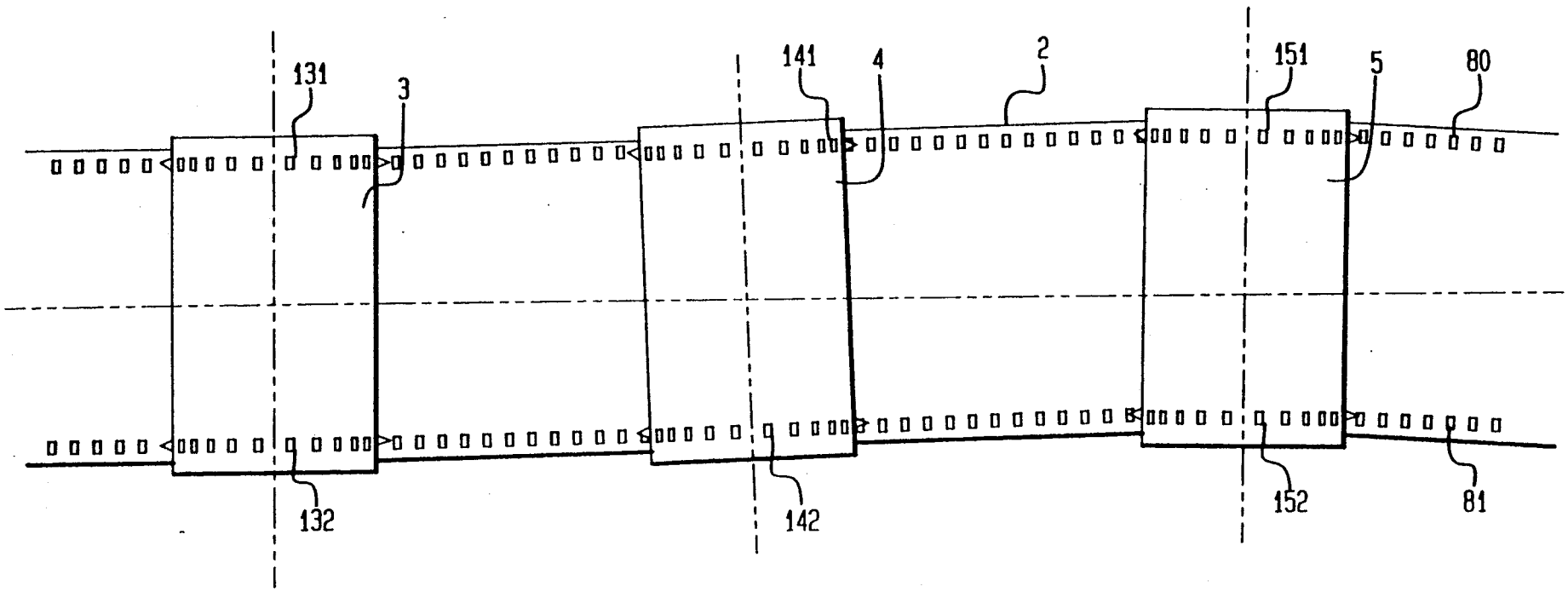
FIG. 8 is a top view of a primary imaging member and three of the secondary imaging members shown in FIG. 7.

According to FIG. 8, primary imaging member 2 has first and second rows of perfs 80 and 81 along its opposite edges. Secondary imaging members 3, 4 and 5 have first sprockets 131, 141 and 151 and second sprockets 132, 142 and 152, respectively, which engage the rows of perfs 80 and 81, respectively.

Figure 7:
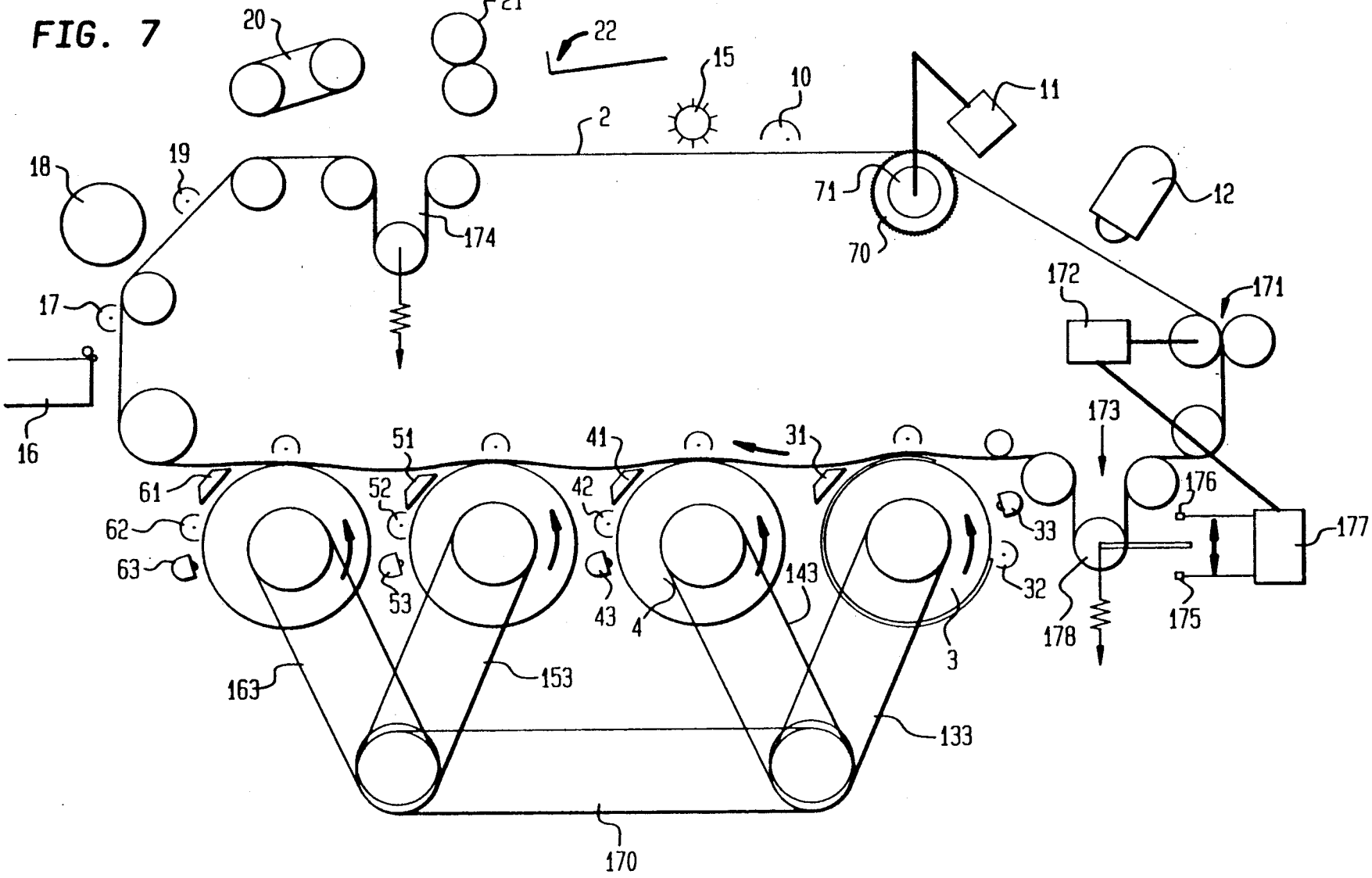
FIG. 7 is a side view of an alternative to the apparatus shown in FIG. 1 illustrating a preferred registration approach.

As shown in FIG. 7, the secondary imaging members 3, 4, 5 and 6 are driven by timing belts 133, 143, 153 and 163 which, in turn, are driven by a single drive 170 so that all four secondary imaging members are driven at substantially constant angular velocity and, particularly, at constant average angular velocity. Comparable structure such as timing chains or gears also could be used. The number of perforations of web 2 between the secondary imaging members is chosen to provide a small amount of slack in primary imaging member 2 between the imaging members.

As seen in FIG. 8, this slack between secondary imaging members permits the web to adjust for skew in the web caused by slight misalignments of the axes of secondary imaging members 3, 4 and 5. That is, as long as a given edge of complementary perfs on opposite sides of primary imaging member 2 stay in engagement with complementary teeth in the sprockets for a given secondary imaging member, the web will be correctly oriented with respect to the axis of the secondary imaging member even though those axes may not be quite parallel (exaggerated in FIG. 8). The slack between the secondary imaging members permits the adjustment shown in FIG. 8. The sprockets are driven to correctly orient web 2 with respect to the axis of the drum with the front of one perforation in each row 80 and 81 engaging one sprocket tooth for each secondary imaging member at any one time. A shoe or vacuum box (not shown) can be used to assure enough drag in the web at each sprocket to assure contact with the front edge of each perf.

Cross-track registration is maintained by the snugness of fit in the cross-track direction between the sprocket teeth and one row of perforations. The other row preferably is not snug in the cross-track direction. Other known web tracking devices can be used to assure cross-track registration. Snugness in the in-track direction is not necessary (or desirable) since the sprockets are driven to engage either the fronts or the rears of both rows of perfs, to provide both skew and in-track registration. In theory, skew and in-track registration is corrected if more than one sprocket tooth in each sprocket engages consecutive perfs. However, such a condition greatly over-constrains web tracking of the system. Thus, it is much preferred that only one tooth in each sprocket engage a single perforation in the web at any one time. This also assures that the correct perf controls image formation and transfer at each key registration position.

The same approach could be used at printhead roller 80. However, since the exposures are all made at a single roller 80, skew correction there is not generally necessary.

The secondary imaging members could be used to drive the web 2, thereby forcing the teeth of the sprockets to the front of each perf. However, perforations wear in time with this approach. Accordingly, a preferred alternative is shown in the FIGS., in which primary imaging member 2 is driven by a pair of nip rollers 171 which, in turn, are driven by a variable speed motor 172. A loop 173, with compensating loop 174, is formed by a movable roller 178 which movable roller is movable between positions sensed by a pair of sensors 175 and 176. The sensors 175 and 176 sense the position of movable roller 178, creating a signal which is fed to logic and control 177 which, in turn, controls variable speed motor 172. Thus, if movable roller 178 moves vertically until it actuates sensor 176, logic and control 177 receives the signal which causes logic and control 177 to speed up variable speed motor 172 to speed up nip rollers 177 thereby speeding up web 2 to increase the size of loop 173. Similarly, if sensor 175 is actuated, the nip rollers 171 are slowed down to reduce the size of loop 173.

This approach can be applied to other similar parallel processes. For example, in FIG. 9 the same registration approach is used when the secondary imaging members 3, 4, 5 and 6 are, in fact, photoconductive members with separate charging, exposing, development and cleaning stations. In this instance, the exposure stations are lasers 39, 49, 59 and 69. In-track registration of the exposures can be controlled by separate encoders (not shown) on each secondary imaging member. Alternatively, the timing belts shown track well enough in many applications to allow exposure off a single encoder 89.

Figure 9:
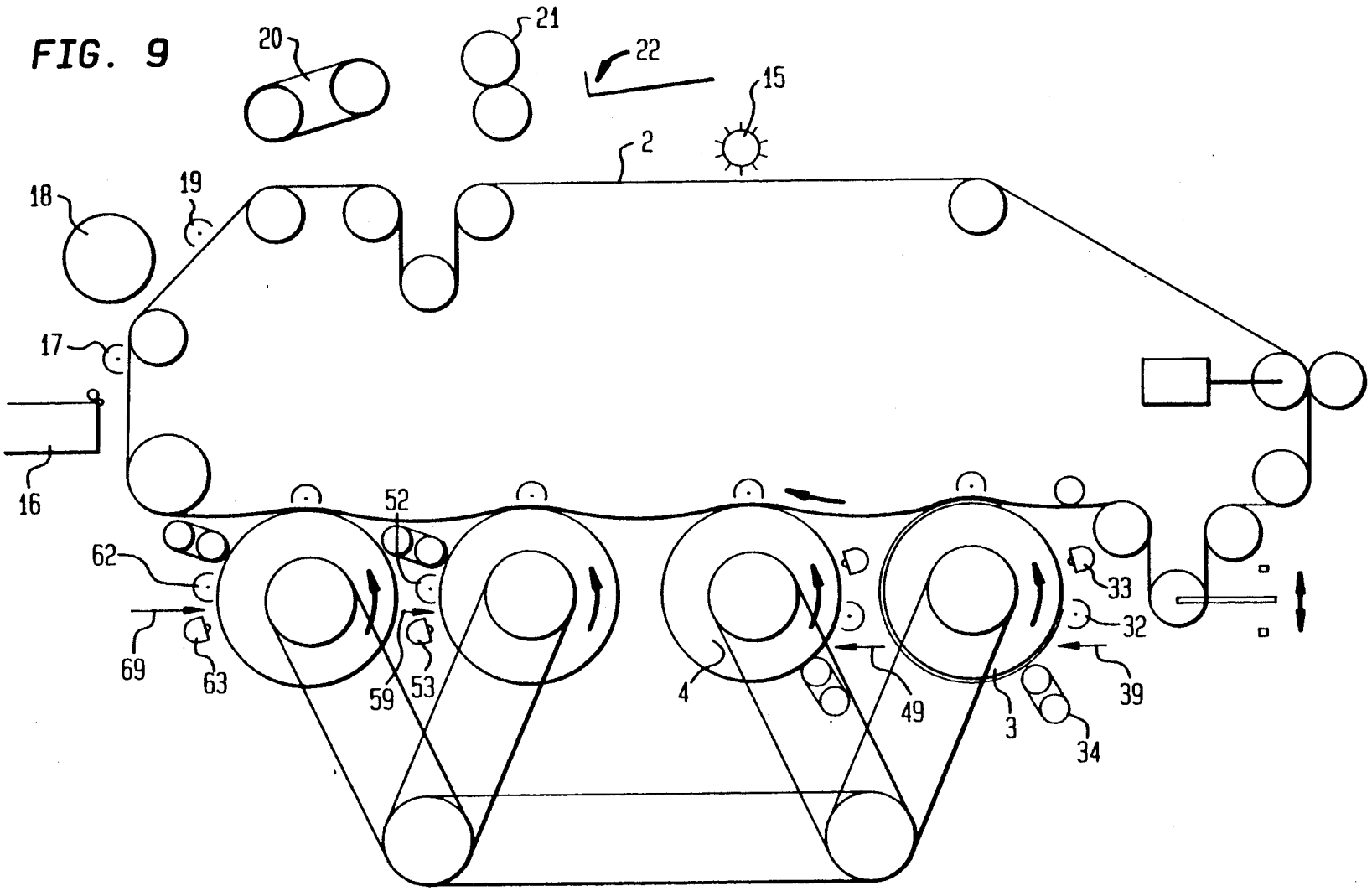
FIGS. 9 and 10 are side views of alternative applications of the registration approach shown in FIGS. 7 and 8.
Figure 10:
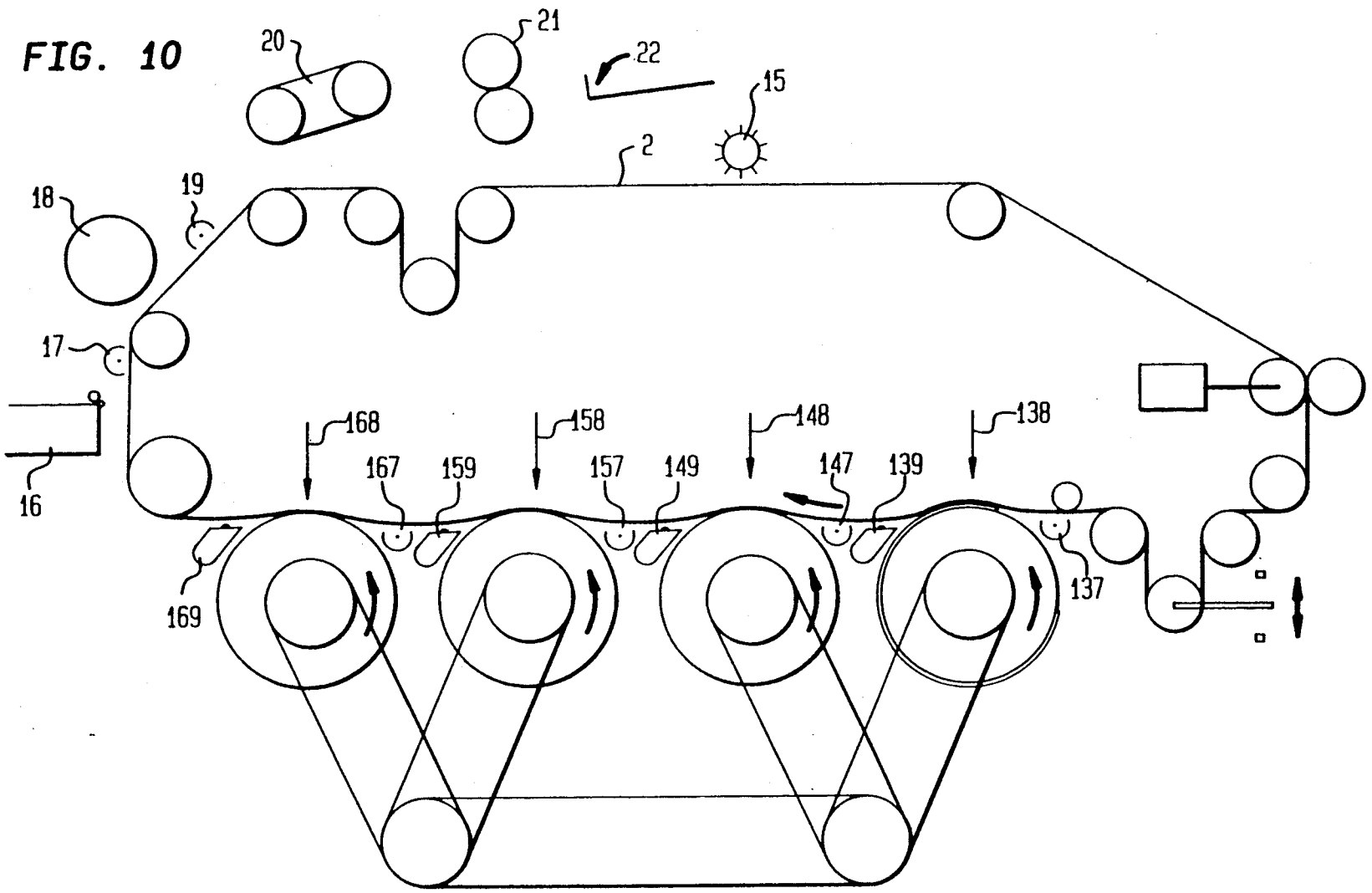

Further, as seen in FIG. 10 the FIGS. 7–9 registration system can be applied to systems where the multicolor image is formed entirely on primary imaging member 2. In this process, primary imaging member 2 is photoconductive and is charged at a first charging station 137 and is exposed through the rear by a laser 138 to create a first electrostatic image. LED printhead 138 is accurately aligned with a drum 103 which supports web 2 and has first and second sprockets as shown in FIG. 8. That first electrostatic image is toned with a toner of a first color at a first toning station 139. Without fusing or cleaning, the same area is again charged at a second charging station 147 and exposed by a second LED printhead exposing station 148 aligned with a second drum 104 to create a second electrostatic image. If enough of the original charge remains and the images do not overlap, the second charging step may not be necessary. The second electrostatic image is toned at a second toning station 149 to create a second toner image of different color than the first toner image. The process is repeated using third and fourth charging stations 157 and 167, third and fourth LED imaging stations 158 and 168 (aligned with drums 105 and 106) and third and fourth toning stations 159 and 169 to create a four-color image. This process is generally known per se: see, for example, U.S. Pat. Nos. 4,308,821; 4,599,285; 4,731,634 and 4,629,669. However, registration between exposure stations 138, 148, 158 and 168 is quite difficult, especially with a web imaging member, and even though they each can be accurately aligned with drums such as drums 103, 104, 105 and 106. As shown in FIG. 10, the registration scheme of FIGS. 7 and 8 can be used for this process as well with each of the drums having first and second sprockets as in FIG. 8. As with the embodiment of FIG. 9, exposure is timed off a single encoder 79 relying on the timing belts and the sprocket teeth and perfs for in-track registration, although again,.separate encoders could be used.

Although FIGS. 9 and 10 illustrate that the registration approach shown in FIGS. 7 and 8 can be extended, it has particular application to the imaging approach shown in FIGS. 1-7. When this registration scheme is used in the FIGS. 1-7 process, the same set of perforations controls primary toner image formation, transfer of the primary toner image to the secondary imaging members and transfer of the color toner images back to the primary imaging member. Registration of the masters is done automatically. It is important for this method that the sprockets be accurately and identically formed and mounted. However, that is generally an easier undertaking than the manufacture of perfs and alignment of drum axes and less likely to be a source of error. Perf error and drum alignment error are largely eliminated as sources of skew or in-track misregistration.

The invention has been described in detail with particular reference to a preferred embodiment thereof, but it will be understood that variations and modifications can be effected within the spirit and scope of the invention as described hereinabove and as defined in the appended claims. For example, where electrostatic images are described as formed by charging and exposing a photoconductive member, they can also be formed by non-optical means, for example, by ion projection. For many purposes, the secondary imaging members need not be drums, but can be endless webs with registration provided by rollers with sprockets fitting perforations in both webs.

I claim:

1. Apparatus for forming multicolor toner images comprising:

an endless web, driveable through an endless path and having a first row of perforations along one edge of said web and a second row of perforations along the other edge of said web, a plurality of imaging members spaced along said endless path, each of said members including a drum shaped member having first and second sprockets engageable with said first and second rows of perforations, respectively, means for forming an electrostatic image on each of said imaging members and for toning said electrostatic images with toners of different color to create a different color toner image on each imaging member, means for transferring said toner images in registration to either said endless web or a receiving sheet carried by said web to create a multicolor toner image, and means for maintaining at least one tooth of each of the first and second sprockets of each imaging member against a given edge of complementary perforations in said first and second rows of perforations to control orientation of said web and imaging member during said transfer.

2. Apparatus according to claim 1 wherein said imaging members are drums having an electrophotosensitive outer surface and said means for creating electrostatic images includes uniform charging and imagewise exposing means associated with each drum.

3. Apparatus according to claim 1 wherein said imaging members are drums having a xeroprinting master around each of their peripheries and said means for creating a color toner image includes charging and toning means associated with each drum.

4. Apparatus according to claim 3 wherein said apparatus includes means for forming a plurality of electrostatic images on said web and means for toning said electrostatic images to form primary toner images and means for transferring each of said primary toner images to a different imaging member and means for forming a xeroprinting master on each of said imaging members defined by said primary toner image.

5. Apparatus according to claim 1 wherein said imaging members are drums and said means for maintaining includes means for driving said drums at a speed at which the sprocket teeth engage the front edge of said complementary perforations.

6. Apparatus according to claim 5 including means for maintaining a predetermined slack in said web at least between said imaging members to facilitate orientation of said web by said sprocket teeth.

7. Apparatus according to claim 6 wherein said means for driving includes means for driving said drums at the same angular speed and said apparatus further includes means for maintaining a variable loop in said web, means for sensing the size of said loop, and means for maintaining the size of said loop within a given range.

8. Apparatus according to claim 1 including means for maintaining a predetermined slack in said web at least between said imaging members to facilitate orientation of said web by said sprocket teeth.

9. Apparatus for forming multicolor toner images comprising:

an endless electrophotosensitive web, driveable through an endless path and having a first row of perforations along one edge of said web and a second row of perforations along the other edge of said web, a plurality of drums supporting said web in a plurality of spaced exposure positions, each of said drums having first and second sprockets engageable with said first and second rows of perforations, respectively, means for maintaining a tooth of each of the first and second sprockets of each drum against a given edge of complementary perfs in said first and second rows, respectively, to control orientation of said web with respect to said drum at said exposure positions, means for uniformly charging said web, first exposure means oriented with respect to a first of said drums for exposing said charged web at the exposure position associated with said first drum to create a first electrostatic image on said web, means for toning said first electrostatic image with a toner of a first color, second exposure means oriented with respect to a second of said drums for exposing said charged web carrying said first color toner image at a second exposure position associated with said second drum to imagewise radiation to create a second electrostatic image in the same portion of said web carrying said first color image, and means for toning said second electrostatic image with a toner of a second color to create a second color toner image which forms with said first color toner image a multicolor toner image.

10. Apparatus according to claim 9 wherein said means for maintaining includes means for driving said drums at a speed at which the sprocket teeth engage the front edge of said complementary perforations.

11. Apparatus according to claim 10 including means for maintaining a predetermined slack in said web at least between said drums to facilitate orientation of said web by said sprocket teeth.

12. Apparatus according to claim 11 wherein said means for driving includes means for driving said drums at the same angular speed and said apparatus further includes means for maintaining a variable loop in said web, means for sensing the size of said loop, and means for maintaining the size of said loop within a given range.

13. Apparatus according to claim 9 including means for maintaining a predetermined slack in said web at least between said drums to facilitate orientation of said web by said sprocket teeth.

14. Apparatus according to claim 1 wherein said means for transferring includes means for transferring said toner images to said endless web to create a multicolor toner image.

15. Apparatus according to claim 7 wherein said means for transferring includes means for transferring said toner images to said endless web to create a multicolor toner image.

16. Apparatus according to claim 1 wherein said means for transferring includes means for transferring said toner images to a receiving sheet carried by said endless web to create a multicolor toner image.

17. Apparatus according to claim 7 wherein said means for transferring includes means for transferring said toner images to a receiving sheet carried by said endless web to create a multicolor toner image.

* * * * *